United States Patent [19]

Björk

[11] 4,157,139

[45] Jun. 5, 1979

[54] APPARATUS FOR SORTING AND/OR HANDLING DISC-LIKE MEMBERS

[75] Inventor: Svante T. Björk, Kungsbacka, Sweden

[73] Assignee: Bertil Knutsson, Göthenborg, Sweden; a part interest

[21] Appl. No.: 863,248

[22] Filed: Dec. 22, 1977

[30] Foreign Application Priority Data

Dec. 28, 1976 [SE] Sweden ..... 7614608

[51] Int. Cl.[2] ..... B07C 5/342

[52] U.S. Cl. ..... 209/552; 209/653; 209/912; 198/445; 198/484; 133/1 R; 221/206; 209/580

[58] Field of Search ..... 209/509, 552, 576, 577, 209/580, 581, 653, 912; 198/445, 482, 484; 133/1 R, 3 R, 4 R, 5 R, 5 A, 5 B, 8 R; 221/206, 207

[56] References Cited

U.S. PATENT DOCUMENTS

| | | | |
|---|---|---|---|
| 1,294,741 | 2/1919 | Winkley | 209/581 X |
| 2,235,899 | 3/1941 | Nolan | 209/653 |
| 2,428,997 | 10/1947 | Seltzer | 133/4 R |
| 2,791,328 | 5/1957 | Beardsley | 209/552 X |
| 3,066,798 | 12/1962 | Toulmin | 209/580 |

*Primary Examiner*—Joseph J. Rolla
*Attorney, Agent, or Firm*—Larson, Taylor and Hinds

[57] ABSTRACT

A device for sorting discs or disc-like members of different identities (e.g. roulette chips) withdraws the discs from a receptacle by a conveyor and moves them in oriented succession along a sorting track where they are automatically indentifed and transferred by transfer devices into respective receiving spaces along the sorting track. The receiving spaces receive the discs at their lower ends so as to form stacks in the receiving spaces, the stacks being built up from their lower ends in inclined troughs forming part of the receiving spaces. Preferably each disc has its leading portion deflected upwardly as it approaches its assigned receiving space, while still retaining driving engagement with the conveyor, and the raised leading portion passes onto a disc catching member at the bottom of the receiving space, after which the disc is driven into the receiving space by the remaining engagement with the conveyor. The troughs of the receiving spaces are formed with longitudinal grooves carrying longitudinally displaceable devices engageable with predetermined numbers of discs at the upper end of the stack, such that the devices may be used to separate and remove predetermined numbers of chips from the stacks.

17 Claims, 8 Drawing Figures

APPARATUS FOR SORTING AND/OR HANDLING DISC-LIKE MEMBERS

FIELD OF THE INVENTION

This invention relates, inter alia, to devices for sorting discs of different identities, and more particularly to sorting devices of the type having a receptacle into which intermingled discs are introduced in batches or more or less continuously, a conveyor withdrawing the discs from the receptacle and moving them in succession along a sorting track, a number of receiving spaces distributed along the sorting track, and an identifying device detecting the identity of each withdrawn disc and controlling a transfer device for transferring the identified discs to the receiving spaces in accordance with their detected identities.

BACKGROUND OF THE INVENTION

Sorting devices of this general type exist in many different embodiments and may be used for sorting discs of widely differing kinds. A common field of application is coin sorting. In this field of application the discs are constituted by coins and their identities are represented by the denominations of the coins and may be ascertained by detecting the dimensions, shape, weight, electrical properties or some other characteristic of the coins by which the denominations differ from one another. There are also fields of application other than coin sorting, such as sorting of tokens, labeling discs, electrical and optical filter discs, coil cores, and so on. Still another field of application is sorting of gaming counters and the like, and the invention will be elucidated by the description of an embodiment which is particularly adapted for the sorting of gaming counters. However, the applicability of the invention is not limited to the sorting of gaming counters, but also embraces sorting of other discs or disc-like objects.

A feature common to most known sorting devices is that they stack the sorted discs. The sorting is usually accomplished under the action of gravity; upon the transfer of the discs from the sorting track, the discs are allowed to drop into a stacking well in which they are collected and from which the stacks are withdrawn downwardly or laterally. This arrangement has some advantages, but is also disadvantageous at least in one respect. This is because it is difficult to withdraw discs, individually or in groups, from the stack without disarranging the stack of discs or without interfering with or being troubled by continued supply of additional discs to the stack from the sorting track. Thus, if a group of discs is withdrawn laterally from the lower portion of the stack, the weight of the upper remaining portion of the stack may make it difficult and physically trying to pull out the group of discs, and when the upper portion of the stack then drops, the discs tend to become disarranged, e.g. by placing themselves edgewise in the well. If discs are withdrawn from the upper end of the stack, new discs arriving from the sorting path tend to interfere with the withdrawal and/or to assume an improper position in the shaft.

In the sorting device according to the invention, on the other hand, provision is made to ensure that discs may easily be withdrawn from the stack, without addition of new discs to the stacks being hampered or causing inconvenience. The location where stacked discs are withdrawn and the location where intermingled discs are charged into the receptacle may easily be disposed at the same level, e.g. at the level of the gaming table in the case the invention is used for the sorting of gaming counters, whereby ergonomic requirements may easily be met. These and other advantages are attained by constructing the device in accordance with the claims.

The invention also relates to devices useable to readily separate and remove predetermined number of discs or chips from a stack made by, for instance, a sorting device in accordance with the invention.

BRIEF DESCRIPTION OF THE DRAWINGS

An exemplary embodiment of the sorting device of the invention, together with exemplary embodiments of separating devices, are illustrated in the accompanying drawings and will be described in some detail hereinafter.

DESCRIPTION OF PREFERRED EMBODIMENTS

Figure 1:
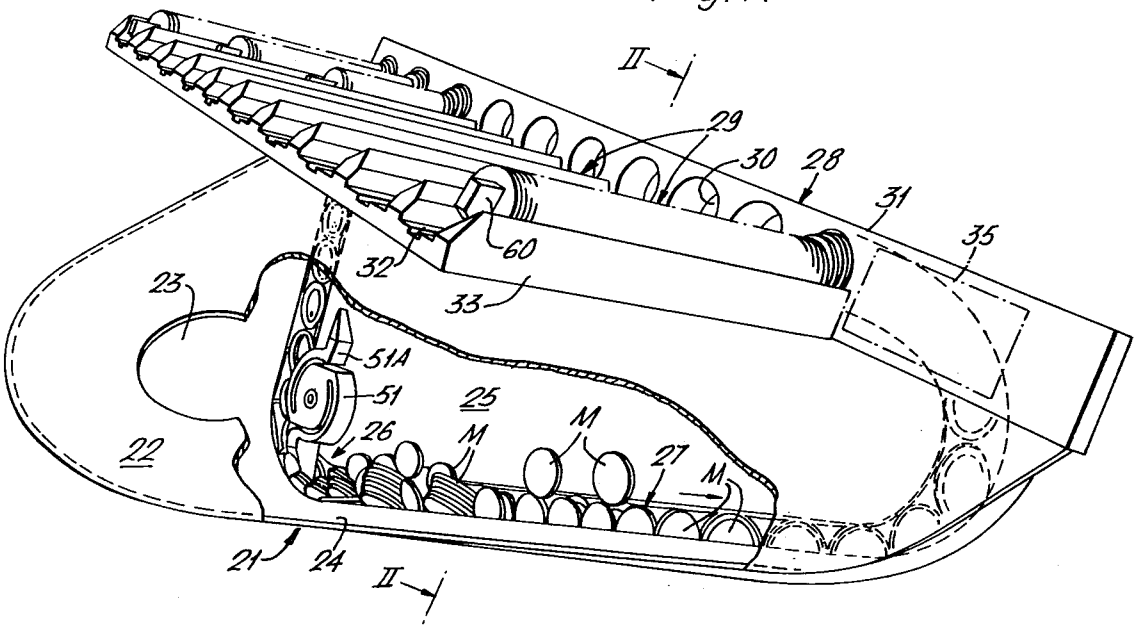
FIG. 1 is a perspective view of the sorting device as seen from the rear and above.

As stated, the illustrated exemplary sorting device is intended for the sorting of gaming counters, namely, roulette chips. These are in the form of flat circular discs which differ from one another only in respect of the color; thus, the identities of the discs are here represented by their colors. The sorting device is adapted to be supported on or adjacent a roulette table (not shown) within convenient reach of the croupier so that the croupier can easily charge the chips to be sorted into the receptacle of the sorting device and pick out larger or smaller piles of sorted and stacked chips and hand them out to the players.

The illustrated sorting device has a feed receptacle 21 serving as a storage for intermingled chips M and having a cover 22 provided with an opening 23 through which the chips may be dropped into the receptacle. The receptacle 21 forms a hopper, i.e., its walls 24 and 25 converge downwardly towards a common bottom region 26. The walls are substantially smooth, and the chips introduced into the receptacle thus tend to slide downwardly towards the bottom region 26.

Through the receptacle runs an endless conveyor, generally designated 27, which passes through the bottom region 26 and draws chips along to a generally horizontal sorting track 28 from which the chips are transferred to receiving spaces 29 formed partly by holes 30 in a discharge bar 31 disposed above the sorting track, partly by troughs 32 provided in an inclined stacking tray and aligned with the holes.

As will become apparent from the following detailed description, the conveyor 27 moves the chips in sequence along the sorting track adjacent or in the bar 31 and then returns to the bottom region of the receptacle 21. Before the chips reach the sorting track 28, they pass through an identifying station, indicated diagrammatically at 35 in FIG. 1, wherein their identity, i.e., color, is detected. In this case the identity is detected photoelectrically, but other identification methods may be used, and the details of such methods or systems are not part of the invention as such. For example, the photoelectric system may comprise a source of light directing a ray of polarized light against the upper face of the chip. The reflected light passes through a polarizer and is then passed in parallel relation through four color filters, each isolating a known part of the spectrum. The light emerging from the four filters is sensed photoelectrically and gives rise to four electric signals the magnitudes of which differ from each other in dependence of the color of the chip being identified. The color of the chip is ascertained by comparing the magnitudes of the signals with each other and with stored data on each color to be identified. The comparison is done by means of a micro-computer which also controls the ejector solenoids 59. On the basis of the result of the detection, there is determined to which of the, for example, ten receiving spaces 29 each individual chip is to be directed or assigned and, as the chip arrives at this receiving space, an ejector (e.g. solenoid 59) ejects the chip into the receiving space. If the receiving space already contains chips, as is shown in FIG. 1 at the receiving space closest to the identifying station 35, these chips form a stack, and the newly added chips will be inserted at the bottom of this stack, Thus, the stacks in the receiving spaces 29 grow from below, and as is apparent from several of the figures in the drawings, the stacks are always readily accessible from above and laterally.

Figure 2:
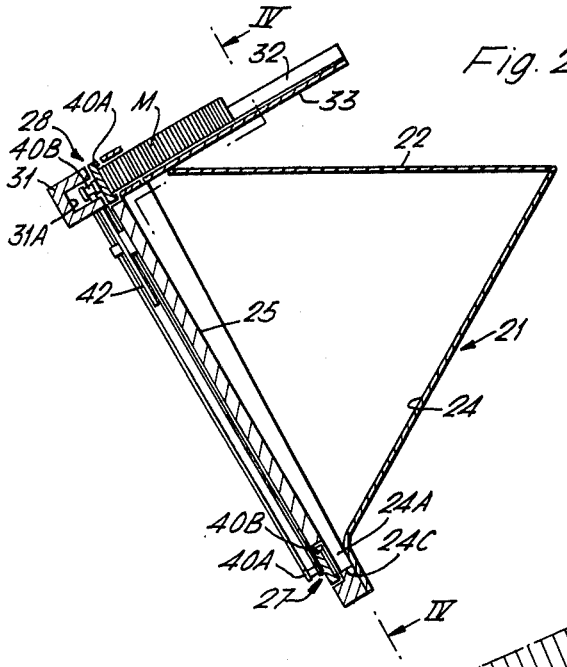
FIG. 2 is a cross-sectional view on line II—II of FIG. 1, certain parts being omitted in the interest of clarity.
Figure 4:
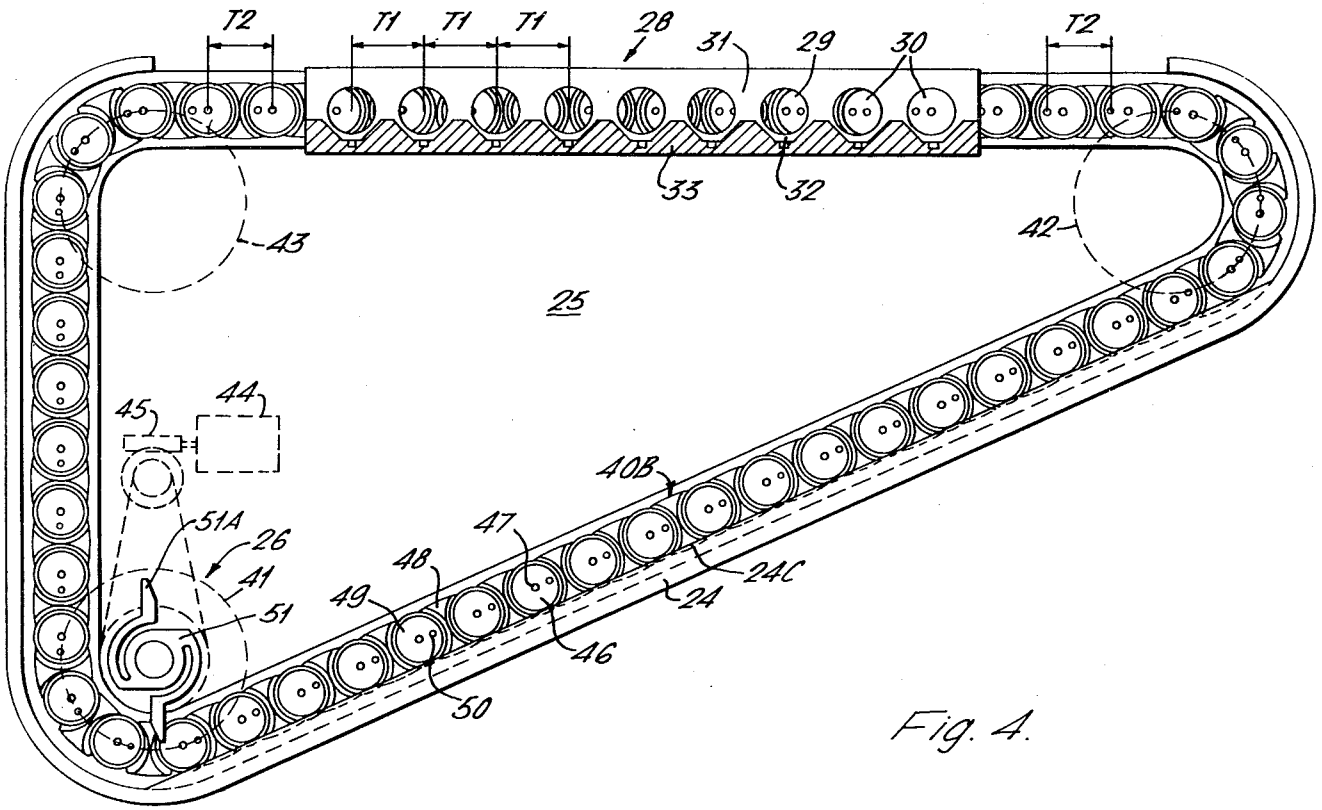
FIG. 4 is a view on line IV—IV of FIG. 2.
Figure 5:
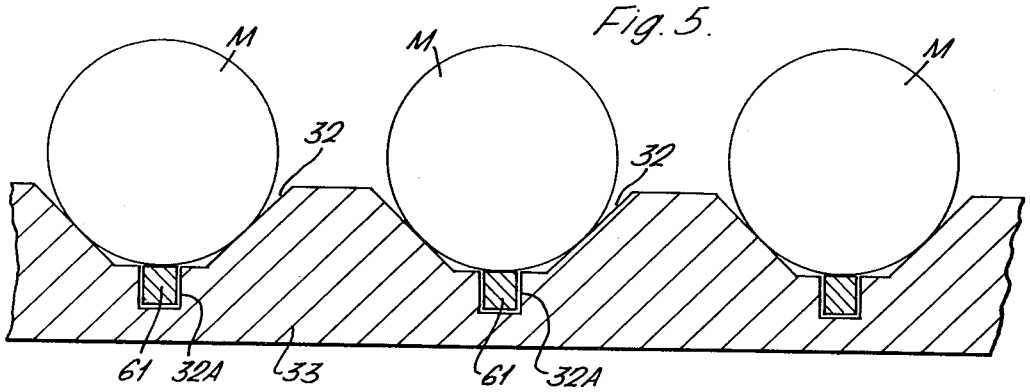
FIG. 5 is a cross-sectional view on line V—V of FIG. 2A.

As is shown in FIGS. 2 and 4 the conveyor 27 includes an endless chain 40 running in the plane of the wall 25 of the receptacle over three sprockets 41, 42 and 43. Of these, the sprocket 41, which is located at the bottom region 26 of the receptacle, is connected with a driving motor 44 through a transmission 45. In operation the chain 40 is moved continuously in the direction indicated by an arrow in FIGS. 1 and 4 along the periphery of the generally triangular wall 25. Over the distance between the bottom region 26 and the horizontal upper edge of the wall 25, the chain thus runs in the pocket formed between the wall 25 and the opposed wall 24 of the receptacle, see particularly FIGS. 1 and 4.

Figure 3:
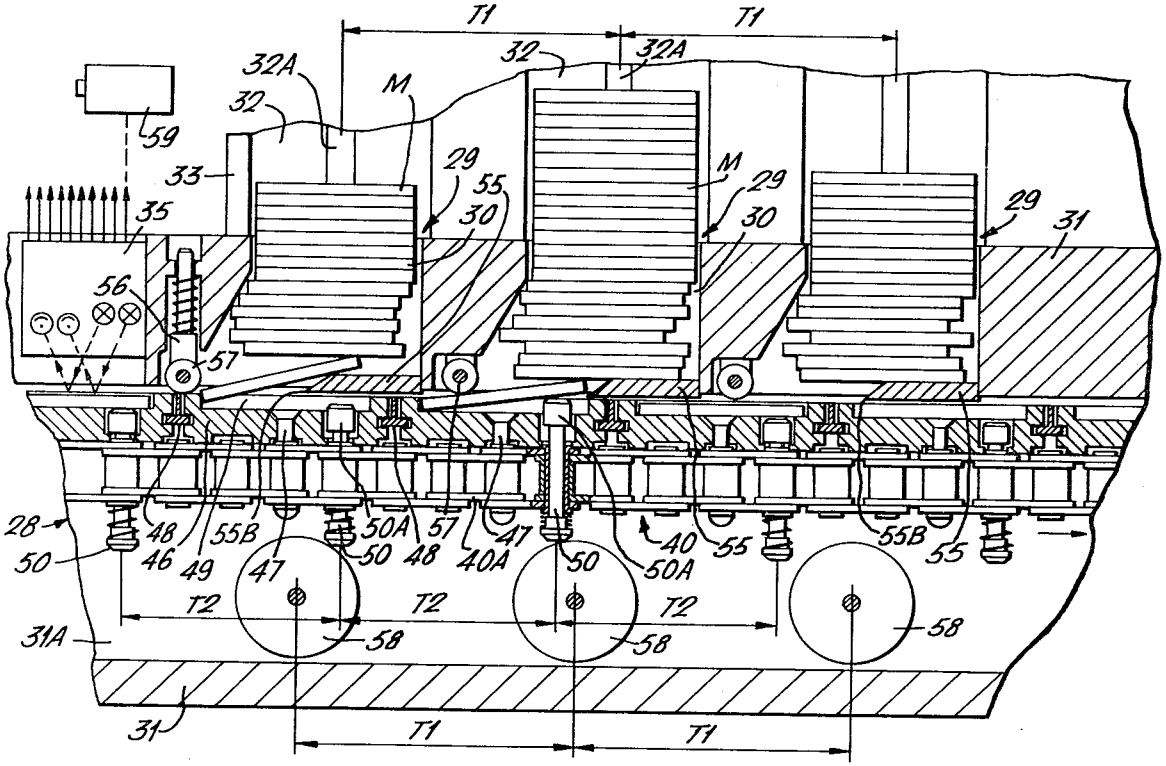
FIG. 3 is a cross-sectional view on line III—III of FIG. 2A.

The construction of the chain 40 is best illustrated in FIGS. 3 and 4. It may be regarded as composed of a chain made up of a lower chain 40A, in this case a roller chain in engagement with the sprockets 41, 42 and 43, and an upper chain 40B, the links of which are mounted on the lower chain. The pitch of the upper chain is a multiple of the pitch of the lower chain, namely, 4 times the latter pitch. The lower chain 40A can thus be a relatively inexpensive standard chain, and the sprockets may have a relatively large number of teeth and relatively small diameter. The links of the upper chain 40B are in the form of plates 46 connected with an associated roller pin of the lower chain through a pin 47 coaxial with the roller pin, see FIG. 3. The link plates 46 thus are disposed transversely to the roller pins of the lower chain and they accordingly are parallel to the wall 25 and may swing relative to one another about axes perpendicular to the wall and thus to the plates.

Between the link plates 46 there are filler plates 48, the upper sides of which are flush with the upper sides of the link plates. The upper sides of the link plates in turn are flush with the upper side (the side facing the wall 24) of the wall 25. Disregarding a recess provided in each link plate 46 and described in greater detail hereinafter, the upper side of the chain 40B thus is generally smooth, and there is a generally even transition between the inclined wall 25 and the upper side of the chain 40B. Accordingly, the upper side of the chain 40B may be regarded as a continuation of the upper side of the wall 25.

The above-mentioned recess in each link plate 46 is formed by a circular cylindrical identation 49 which is concentric with the pin 47 and only slightly larger in diameter than the chips M and which is of a depth substantially equal to (preferably slighly less than) the thickness of the chips. Consequently, each link plate can only receive a single chip in its indentation 49, and when a chip is received in the indentation the upper face of the chip forms a generally smooth extension of the upper face of the link plate.

Each link plate 46 also has an axially displaceable ejector pin 50 which is disposed within the recess 49 at a point ahead of the pin 47 and which is parallel to the pin 47.

The ejector pin 50 extends through that tubular roller pin of the chain 40A which is disposed ahead of the pin 47, and it is spring-biassed towards a lower position in which the upper end 50A of the ejector pin is slightly below the bottom of the indentation. As will be described in greater detail hereinafter the ejector pin can be displaced upwardly against the spring bias to raise the leading portion of a chip in the recess shortly before the chip arrives at the receiving space 29 to which it has been directed or assigned by the electronic control device.

In the lowermost region 26 of the receptacle 21 there is provided an agitator 51 which is secured to the shaft carrying the sprocket 41 and provided with a couple of radial arms 51A. When the conveyor 27 is in operation these arms sweep over the wall 25 of the receptacle and thereby ensure that the chips in the receptacle are agitated. Thus, the agitator prevents the chips from forming bridges or otherwise becoming wedged together or stuck in the receptacle.

When a batch of intermingled chips has been charged into the receptacle 21, the chips tend to collect at the lowermost region 26 because of the inclination of the walls of the receptacle, but at the same time the movement of the upper chain 40B upwardly towards the sprocket 42 causes the chips to be spread out along the inclined groove 24A (FIG. 2) formed by the walls 24 and 25. Because of the construction of the groove (the groove is narrow and inclined), see FIG. 2, the chips which are thus dragged along upwardly tend to lean against the chain 40B and/or the wall 25. Since the chips are constantly subjected to gravity force and thus tend to move downwardly towards the bottom of the groove and towards the lowermost region 26, and since they are constantly subjected to impacts because of the movement of the chain and the movement of adjacent chips, they have a tendency to move towards the bottom 24C of the groove 24A and into the indentation 49 of an unoccupied link plate 46.

As the chain 40B moves along the straight section of the wall 24 it may very well happen that all indentations 49 along that section are occupied by chips and that on top of the chain and the chips received in the identations there is a more or less disordered layer of loose chips which have not found any unoccupied indentation. One or a few of these loose chips may possibly be dragged along by the chain into the region where the chain starts bending over the sprocket 42, but in that region the gravitational force tending to move the chip downwardly prevails because of the inclination and the chip therefore slides back downwardly. In the bending region the chain also passes under a wiper (not shown) which prevents any loose chips brought along by the chain from proceeding further together with the chain.

As shown in FIG. 2 the width of the groove 24A increases continuously towards the sprocket 42. This will effectively prevent the chain from wedging the chips against the sidewalls of the groove.

On the other hand, each chip that has found and been received in the indentation 49 of a link plate can readily move together with the chain through the chain bending region and enter the identification station 35 and the sorting track 28. Because of the illustrated and described construction of the receptacle 21 and the conveyor 27 and the consequent spreading of the chips along the groove 24A, it is very unlikely that a link plate 46 will arrive at the identifying station 35 without having its identation 49 occupied by a chip, as long as there is a larger number of loose chips left in the receptacle 21. Accordingly, as long as the receptacle 21 contains a large number of loose chips, the capacity of the conveyor is utilized to a maximum degree. However, if one or more link plates should be unoccupied, this is of no practical significance as regards the ability of the device to sort the chips.

As is apparent from the foregoing description, the conveyor 27 is effective to withdraw the unsorted chips individually from the receptacle 21 and to move them in succession through the identifying station 35 and further along the sorting track, where each chip is ejected to the particular receiving space 29 intended for chips of the identity which has been ascertained for the chip. If it is not possible to reliably ascertain the identity of a particular chip, that chip is allowed to move past all receiving spaces and then ejected to a reject space (not shown).

FIG. 3 illustrates the construction and operation of the sorting path 28. The discharge bar 31 is provided with a longitudinal horizontal passage 31A for the chain 40. Into this passage open the holes 30 the axes of which are perpendicular to the longitudinal axis of the passage and to the wall 25 of the receptacle 21. The cross-section of the holes is somewhat elongated adjacent the passage but gradually assume circular shapes upwardly. A deflector plate 55 secured to the bar 31 forms a partition between the semi-circular front (right-hand) section of each hole 30 and the passage 31A. The straight edge of 55B of the deflector plate 55 directed against the direction of movement of the chain 40 is chamfered on the upper side and thus forms a knife-edge. The deflector plate forms a sort of bottom of the hole 30 and also serves to support the chips therein; the deflector plate covers a sufficiently large portion of the hole 30 to enable the stack of chips to rest in a stable manner thereon.

Behind (to the left of) each hole 30 is a downwardly spring-biassed hold-down member 56 having a rotatable roller 57 adapted to roll on the top side of the upper chain 40B and the chips carried thereby. The function of the hold-down member, which usually is not necessary, will be explained hereinafter.

In the region of each receiving space 30 the passage 31A houses a rotatable ejector roller 58 the axis of rotation of which is perpendicular to the direction of movement of the chain 40 and to the plane containing the roller pins 47 and the ejector pins 50 of the chain section accommodated in the passage. The ejector roller 58 is axially displaceable between an inactive position in which it is laterally offset from the path of movement of the ejector pins, and an ejecting position (indicated in dash-dot lines in FIG. 2A) in which it is in the just-mentioned plane. When the ejector roller 58 is in the inactive position, the ejector pins 50 can move past it without engaging it, but in the active position the ejector roller pushes the moving ejector pins upwardly against the action of their biasing springs, see the most centrally situated one of the five ejector pins shown in FIG. 3.

The displacement of the ejector roller 58 is effected by means of a solenoid 59 which is operated by the afore-mentioned electronic control apparatus in accordance with the result of the identification in the station 35. All ejector rollers normally are in the inactive position but when a link plate 46 with a chip which has been assigned or directed to a particular receiving space approaches the ejector roller associated with that receiving space, the solenoid is supplied with an impulse to place the roller in the active position for a brief interval. The ejector pin 50 of that link plate is then forced upwardly to lift the leading portion of the chip to a level slightly above the level of the edge of the deflector plate 55 of the receiving space; this is shown at the central one of the three receiving spaces illustrated in FIG. 3. The thickness of the deflector plate 55 and the chamfering of its edge 55B are such that it is initially sufficient for the ejector pin to raise the chip just above the knife-edge sufficiently to ensure that the chip is deflected. Thus, it is not necessary for the ejector pin to overcome the weight of the chips already stacked in the hole 30. The hold-down member 56, if present, retains the trailing portion of the chip in the indentation 49 of the link plate and during the continued movement the chip will be pushed in between the deflector plate 55 and the lowermost one of the earlier inserted chips causing the stack of chips already accommodated in the receiving space to be lifted. This is shown at the left one of the three receiving spaces in FIG. 3.

After the chip has been moved past the hold-down member 56, it is swung to the position shown at the right one of the three receiving spaces in FIG. 3 under the weight of the overlying chips. Since the propulsive force exerted by the chain then ceases, the chip will stop in that position in which it still has not reached its maximum advanced position. However, next time a chip is inserted as described, that chip will likely advance the overlying chip as far as possible. If, for one reason or other, the chip is not advanced to the wall of the hole 30, insertion of additional chips will cause the oblique rear wall of the hole 30 to force the chip to move forwardly as it is gradually raised. Therefore, when the chips reach the trough 32 they form a regular stack.

As soon as the ejector roller 58 has pushed the ejector pin 50 upwardly and allowed it to return downwardly, it returns to the inactive position to permit the next succeeding ejector pin to pass without engagement. Naturally, the displacement to the active position must take place only immediately prior to the moment when the ejector pin to be engaged reaches the ejector roller, i.e., only after the next preceeding ejector pin has passed.

In this case there are ten receiving spaces 29, which are uniformly spaced by a pitch distance T1 which is equal to the pitch distance by which the ten ejector rollers 58 are uniformly spaced. The pitch distance T1 is different from the pitch distance T2 by which the ejector pins 50 and the link plates 46 are uniformly spaced, such that it never can happen that two or more ejector pins 50 are engaged simultaneously, even if all ejector rollers 58 should happen to be in the active position. This can be achieved if T2:T1=11:10, for example. Such an arrangement prevents the sudden and heavy loads on the sorting track which would occur if many ejector pins were actuated simultaneously, and moreover it results in a lowering of the noise level.

The electronic control apparatus (not shown), which operates in response to signals it receives each time a chip passes the identification station 35 and on the basis of these signals determines which one of the ten receiving spaces 29 is to receive the chip, naturally activates the solenoids 59 with delay times varying from one solenoid to the next in proportion to the distance between the identifying station on the one hand and the receiving spaces on the other hand. The control device may also include a means for automatically stopping the chain 40 after a certain preset time has elapsed after a chip (the last chip withdrawn from the receptacle 21) has passed the identifying station 35 and automatically restarting it upon charging of additional chips into the receptacle 21.

Figure 2A:
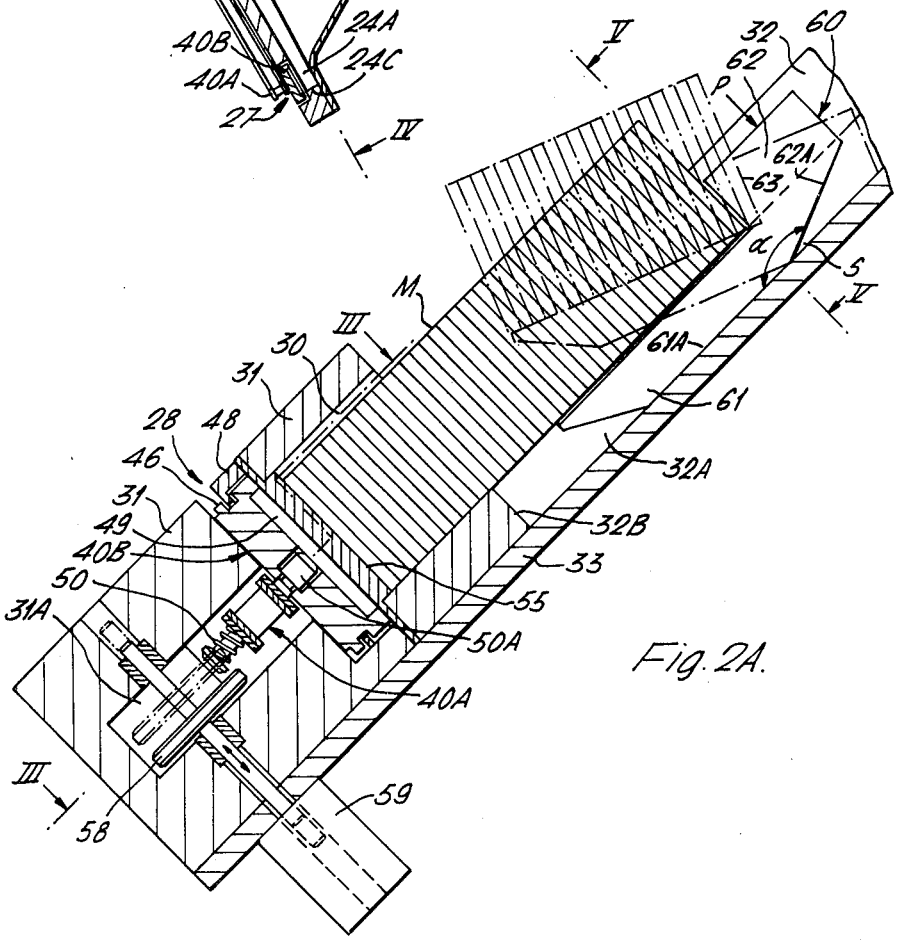
FIG. 2A is an enlarged cross-sectional view corresponding to the top lefthand portion of FIG. 2 and including additional details.

At any time, even during the sorting, the croupier may pick out chips from the stack tray 33. FIG. 2A shows a device the croupier may use to readily separate and pick out a predetermined number of chips, e.g. 20 chips, from the stack. This device is in the form of a flat gage hook 60 having a shank 61 with rectangular cross-section and a head 62 with a shoulder 63 which is perpendicular to the longitudinal axis of the shank. The distance between the free end of the shank and the shoulder is equal to or only slightly larger than the height of the pile formed by the predetermined number of chips. The back side 61A of the shank facing away from the shoulder is straight over the major portion of its length and defines an obtuse angle $\alpha$ with the straight back side 62A of the head 62.

At the bottom of each trough 32 of the inclined stack tray 33 there is a groove 32A the cross-section of which is slightly larger than the cross-section of the shank 61, and when the gage hook 60 is inserted in the groove 32A as shown in FIG. 3, its shank is entirely behind the stack of chips. As long as the height of the stack of chips in the trough is below a given value, the free end of the shank is supported by an end wall 32B of the groove 32, but as the stack grows past this height, the shank is gradually pushed upwardly since the head 62 engages the top chip of the stack.

When the croupier wishes to pick out the predetermined number of chips, he presses with a finger on the head 62 of the gage hook 60 as indicated by an arrow P in FIG. 2A so that the hook tilts about the juncture S of the back sides 61A and 62A of the shank and the head. The pile of chips registering with the shank 61 is then moved together with the shank to the position indicated by broken lines so that the croupier can readily grasp it with his other fingers. When the croupier then releases the gage hook, which in this position engages the top chip in the trough 32, the hook automatically tilts back about the juncture S to the position shown in full lines in FIG. 2A so that the shank of the hook can slide downwardly in the groove 32A behind the stack.

Figure 6:
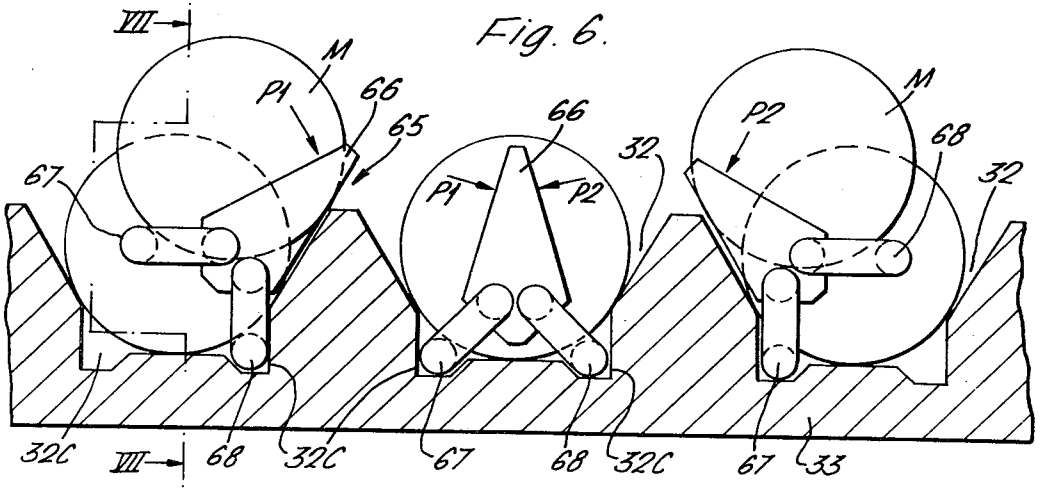
FIG. 6 is a cross-sectional view similar to FIG. 5 and showing a modification.
Figure 7:
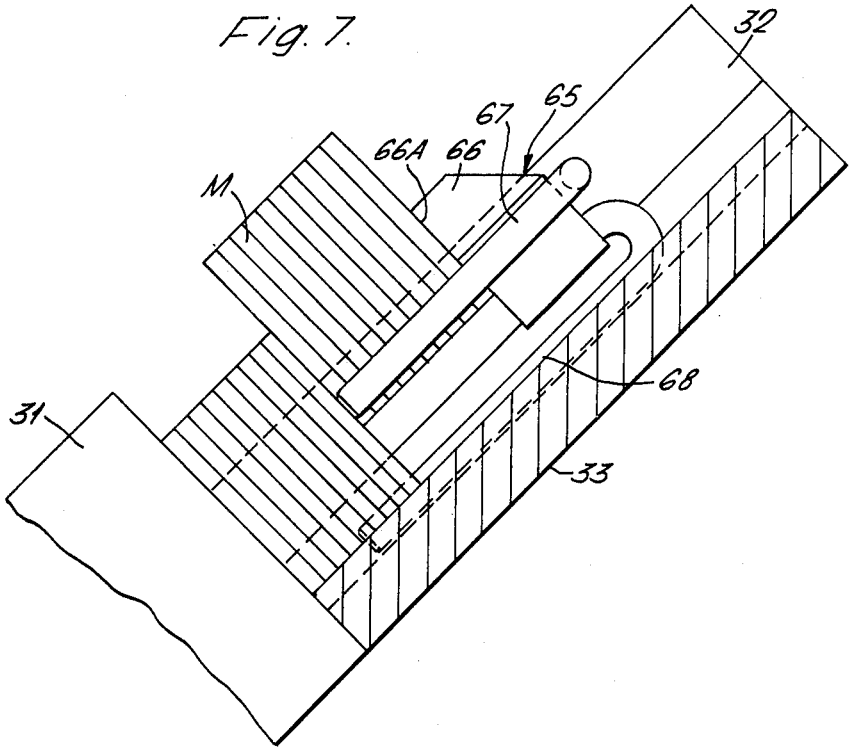
FIG. 7 is a cross-sectional view on line VII—VII of FIG. 6.

FIGS. 6 and 7 show a modified embodiment of the device. By means of this device the croupier can pick out either of two different numbers of chips, according to in which way he manipulates the device. In this case the device is in the form of a gage hook 65 having a head 66 and two parallel shanks or limbs 67, 68 of different lengths. The lower part of the head 66 has a support surface 66A which is perpendicular to the limbs, and the distance between the support surface and the free end of the limb 67 corresponds to the height of a pile of ten chips, for example, while the corresponding distance at the limb 68 corresponds to the height of a pile of fifteen chips, for example. The bottom of the trough 32 of the stack tray 33 in this case has two grooves 32C in which the limbs 67, 68 are slidably receivable behind the stack of chips, see the central portion of FIG. 6. Further details of the hook 65 are apparent from FIGS. 6 and 7.

If the croupier wants to pick out a pile of ten chips, for example, he presses with a finger on one side of the head (arrow P1 in FIG. 6). The hook then swings about the long limb 68 and the short limb 67 displaces the top ten chips and moves them to the laterally offset position shown in the left in FIG. 7. The croupier then can readily grasp the offset ten-chip pile and pick it out from the trough 32. As he then releases the hook, it automatically swings back so that the limbs can slide down behind the remaining stack. If instead he wants to pick out fifteen chips, he presses on the other side of the head (arrow P2) so that the hook swings about the short limb 67 and the long limb displaces the top fifteen chips laterally to the offset position shown to the right in FIG. 6.

Naturally, both limbs may have the same length so that the same numbers of chips are picked out regardless of the direction in which the hook is swung.

The illustrated and described apparatus only is an examplary embodiment, and many other embodiments fall within the scope of the invention. For example, the transfer of the discs from the conveyor to the receiving spaces may take place in ways and using means other than those shown in the drawing.

Thus, the discs may be raised from the conveyor by means of a deflector disposed above the path of movement of the conveyor and being in the form of a finger, a flap or the like which in response to a signal from the identifying means is placed in an active position in which it engages and raises the leading portion of an approaching disc to deflect the disc into the receiving space. Such a deflecting flap or finger may be connected to the front edge of the bottom plate 55 of the receiving space and pivotable about a horizontal axis. In the active position its distal end may engage in a longitudinal groove in the chain plates so that the leading portion of the chip is caused to slide up the ramp formed by flap or finger as the chain advances the chip.

Moreover, the identification may take place in the region of each individual receiving space. In such case the identifying means of each receiving space is adapted to respond only to discs of the identity for which the receiving space is intended. Accordingly, when a disc of a different identity passes, the identifying means is not actuated, that is, it does not bring about a switching of a transfer mechanism to an active position.

Naturally, the conveyor may also take forms other than that shown. For example, the elements of the conveyor which receive discs in the feed receptacle need not necessarily have circular indentations as in the illustrated embodiment but may have lugs or other types of driving members capable of retaining the discs in a fairly well defined position so that the discs move along generally identical paths along the sorting track.

It is not absolutely necessary that the receiving spaces are above the sorting path. It is conceivable, although probably disadvantageous in many respects, to deflect the chips laterally or downwardly and laterally. The lower end of the receiving space may be disposed laterally adjacent the chip - carrying indentations of the conveyor and in a common plane therewith, and a deflector may be provided to deflect the chips generally in their own planes from the conveyor into the receiving spaces. Preferably the disc catcher members with their inclined edges would still be used, but re-oriented to face the deflected chips. It is important, however, that the disc stacks in the receiving spaces are supplied with new discs at the bottoms of the stacks and are disposed such that the stacks therein are accessible from above the sorting track.

I claim:

1. Device for sorting discs of different identities, said device comprising: (a) a feed receptacle for receiving discs to be sorted, (b) conveyor means for withdrawing discs individually from the feed receptacle and moving them in succession along a sorting track, (c) a plurality of disc receiving spaces disposed along the sorting track, each receiving space being intended for receiving and stacking discs of a particular identity, (d) identifying means for assessing the identity of each withdrawn disc, and (e) transfer means controlled by the identifying means for transferring discs disposed on the sorting track to the receiving spaces in accordance with the identity as established by the identifying means, characterized in that (1) the conveyor means comprises an endless, continuous conveyor passing through the feed receptacle and having a plurality of successive discs carriers to be occupied by a disc in the feed receptacle, (2) the receiving spaces are disposed adjacent the sorting track and the path of the disc carriers, (3) the transfer means comprise, in the region of each receiving space an individually operable disc deflecting mechanism which is shifable under the control of the identifying means between an inactive position to permit discs on the disc carriers of the conveyor to pass the receiving spaces and an active position to deflect toward the lower end of a receiving space a disc occupying a disc carrier approaching that receiving space, and (4) at the bottom of each receiving space a disc stack support is provided having a disc catching member which is disposed below the adjacent portion of the disc when the adjacent portion is in the deflected position.

2. Device according to claim 1, characterized in that the conveyor comprises a first chain and a second chain carried by the first chain, the links of the second chain being formed by the disc carriers and arranged with a pitch which is an integral multiple of the pitch of the links of the first chain.

3. Device according to claim 1, characterized in that the disc carriers are arranged at regular intervals on the conveyor and the receiving spaces are likewise arranged at regular intervals along the sorting track, the distance between adjacent disc carriers differing from the distance between adjacent receiving spaces such that at any given moment all disc carriers along the sorting track have different positions relative to the receiving spaces.

4. Device according to claim 1 wherein said disc deflecting mechanism in its active position raises the leading portion of a disc while maintaining a driving engagement between the disc carrier and the disc, and said disc catching member is disposed below the leading portion of the disc when the leading portion is in the raised position, such that continued driving of the raised disc moves the raised disc from the disc carrier onto said disc catching member and hence into the associated receiving space as the bottom member of the stack.

5. Device according to claim 4, characterized in that each disc carrier has a recess provided on one side of the disc carrier and dimensioned to accommodate a single disc and comprises an ejector adapted to be moved into the recess and having a portion projecting from the opposite side of the disc carrier, and each disc deflecting mechanism comprises a camming member disposed below the path of movement of the disc carriers and movable between an active position in the path of movement of the projecting ejector portion and an inactive position clear of the last-mentioned path of movement.

6. Device according to claim 5, characterized in that the path of movement of the conveyor is disposed in an inclined plane and comprises a generally horizontal section along which the receiving spaces are disposed.

7. Device according to claim 6, characterized in that the conveyor runs along an inclined bottom edge of an inclined wall of the feed receptacle and has a generally flat face directed towards the interior of the feed receptacle disposed in or adjacent the face of said wall, and each of the disc carriers has said recess provided in said flat face and dimensioned to accomodate a single disc.

8. Device according to claim 7, characterized in that said face of the portion of the conveyor running along said lower edge defines a groove jointly with an adjoining wall, said groove having a dimension measured transversely of the flat conveyor face larger than the thickness of the discs but smaller than their width, the bottom of the groove being tangential with respect to the lowermost portion of the recesses.

9. Device according to claim 6, characterized in that each receiving space includes a disc stack trough extending transversely of the inclined plane and open obliquely upwardly so that a disc stack in the trough can be freely grasped with a hand.

10. Device according to claim 9, characterized in that the bottom of the disc stack trough is formed with at least one longitudinal groove in which a gage hook is displaceable longitudinally of the trough, said gage hook having a head adapted to rest against the top disc of a disc stack in the trough and a shank projecting downwardly from the head, which shank is receivable in the groove behind the disc stack and, in response to manipulation of the head, swingable relative to the trough to displace the discs disposed between the head and the free end of the shank as a unit laterally relative to the discs of the stack situated below the gage hook.

11. Device according to claim 10, characterized in that the gage hook is swingable, in response to pressure against the head directed towards the bottom of the groove, in a vertical plane passing through the axis of the groove about an edge situated near the head end of the shank and forming a transition between a pair of angularly offset sides of respectively the shank and the head, said sides facing the bottom of the groove.

12. Device according to claim 10, characterized in that the shank of the gage hook comprises two parallel limbs receivable in respective ones of a pair of parallel longitudinal grooves in the bottom of the disc stack trough, the gage hook being swingable about the axis of either one of the limbs by lateral pressure on one side of the head.

13. Apparatus according to claim 12, characterized in that the limbs have different lengths.

14. A device for storing and handling stacked discs, comprising a disc stack trough inclined to the horizontal so as to have an upper end and a lower end, said trough being open upwardly at least toward its upper end so that at least part of a disc stack in the trough can be removed upwardly, at least one longitudinal groove formed in the bottom portion of said trough so as to be beneath a disc stack in the trough, and a disc remover longitudinally displaceable in the trough for displacing from the trough a predetermined number of discs counting from the upper end of a disc stack, said remover having a head adapted to rest against the disc at the upper end of a stack and shank means projecting downwardly from the head along the groove so as to underlie said predetermined number of discs in a stack, such that upon manipulation of said head said shank is swingable relative to said trough means to displace discs disposed between said head and the free end of said shank means as a unit laterally relative to discs of the stack situated below the free end of said shank means.

15. A device as claimed in claim 14 wherein said remover includes means forming a pivot on its underside in said trough means such that downward pressure on said head toward the bottom of said groove effects upward pivotal movement of said shank means about said pivot and at least partially out of said groove means.

16. A device as claimed in claim 14 wherein said shank means comprises two parallel limbs receivable in two parallel grooves, such that said remover is swingable about the axis of either one of the limbs by lateral pressure on a respective side of said head, said limbs being of different lengths such that swinging movement in each direction will displace a different predetermined number of discs.

17. A device as claimed in claim 14 further comprising means for sequentially automatically passing chips into the lower end of said trough to build up a disc stack from said lower end.

* * * * *